US007717179B2

(12) United States Patent
Rayssiguier et al.

(10) Patent No.: US 7,717,179 B2
(45) Date of Patent: May 18, 2010

(54) METHOD AND APPARATUS TO SET A PLUG

(75) Inventors: Christophe Rayssiguier, Melun (FR); Mickael Allouche, Paris (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 40 days.

(21) Appl. No.: 12/064,345

(22) PCT Filed: Jul. 14, 2006

(86) PCT No.: PCT/EP2006/006954

§ 371 (c)(1),
(2), (4) Date: Aug. 18, 2008

(87) PCT Pub. No.: WO2007/022834

PCT Pub. Date: Mar. 1, 2007

(65) Prior Publication Data

US 2009/0183875 A1 Jul. 23, 2009

(30) Foreign Application Priority Data

Aug. 25, 2005 (EP) ..... 05291785

(51) Int. Cl.
*E21B 33/134* (2006.01)
*E21B 33/127* (2006.01)

(52) U.S. Cl. ..... 166/285; 166/187; 166/387

(58) Field of Classification Search ..... 166/285, 166/187, 387

See application file for complete search history.

(56) References Cited

U.S. PATENT DOCUMENTS

| | | | | |
|---|---|---|---|---|
| 2,922,478 | A | 1/1960 | Maly | |
| 3,460,625 | A | 8/1969 | Herbert | |
| 4,628,996 | A * | 12/1986 | Arnold | 166/116 |
| 5,167,710 | A * | 12/1992 | Leroux et al. | 106/711 |
| 6,513,601 | B1 | 2/2003 | Gunnarsson et al. | |
| 2004/0188954 | A1 * | 9/2004 | Naquin et al. | 277/605 |

* cited by examiner

*Primary Examiner*—Giovanna C Wright
(74) *Attorney, Agent, or Firm*—David Cate; Robin Nava; Jeff Griffin

(57) ABSTRACT

The invention provides an apparatus to be lowered in a borehole, comprising: (i) a delivery section for delivering a plugging fluid; (ii) a setting section comprising a longitudinal element and a flexible and permeable sleeve into which the plugging fluid is delivered; and (iii) a disconnect mechanism to allow the delivery section to be disconnected from the setting section, characterized in that the flexible sleeve is connected by at least one floating means to the longitudinal element. Additionally, the invention provides a method of installing a plug in a borehole, comprising: positioning the apparatus as described above in the borehole at a position at which the plug is to be installed, pumping fluid into the flexible sleeve via the delivery section so as to inflate the flexible sleeve, disconnecting the setting section from the delivery section, pumping an excess of the fluid into the borehole above the plug and withdrawing the delivery section from the borehole leaving the setting section at the position, said setting section acting as the plug.

22 Claims, 7 Drawing Sheets

METHOD AND APPARATUS TO SET A PLUG

FIELD OF THE INVENTION

The present invention relates to an apparatus and associated method for setting plugs, in boreholes of oil, gas, water or geothermal wells or the like.

DESCRIPTION OF THE PRIOR ART

Setting cement plugs in a borehole is a common oilfield operation. A cement plug involves a relatively small volume of cement slurry placed in a borehole for various purposes: (i) to sidetrack above a fish (a piece of equipment stuck in a borehole that cannot be removed) or to initiate directional drilling; (ii) to plug back a zone or plug back a well; (iii) to attempt to solve lost circulation problems during the drilling phase; and (iv) to provide an anchor for open hole tests.

One problem in setting cement plugs is that it can be difficult to retain the cement slurry in position in the borehole, especially when the plug is being set above the lowest point of the borehole ("off bottom"). Since cement slurries are often denser than borehole or drilling fluids, there is a natural tendency for the slurry to sink to the bottom of the well. U.S. Pat. No. 5,667,015 proposes a well barrier for maintaining a separation between an upper and a lower part of the well.

There have been previous proposals that attempt to address this problem by using a downhole sleeve to confine the cement to a specific zone of the well. Examples of this can be seen in U.S. Pat. Nos. 2,796,134, 3,032,115 and 3,460,625. In those cases, a delivery pipe is placed in the well with openings to allow cement to pass into the annulus. A sleeve is located around the openings and cement is pumped through the pipe into the sleeve to inflate it and seal against the formation. Suitable materials proposed for these uses are plastic or rubber. Once the cement has set, the delivery pipe is disconnected above the sleeve and the portion in the sleeve can be drilled out leaving the cement sheath in place. In these schemes, an impermeable sleeve is used to ensure that the cement is confined to the area of interest. In another example, U.S. Pat. No. 5,738,171 from Szarka describes an inflatable packer, without connector, and U.S. Pat. No. 6,578,638 from Guillory et al. describes an inflatable packer to be set above a lost circulation zone, then cement is injected into that zone before disconnecting it mechanically. None of these proposals demonstrate particularly effective cement properties in the region of particular interest: the borehole wall.

Some improvements have been realized in patent application WO 03/042495. An apparatus for setting a plug in a borehole zone is proposed using a flexible and expandable sleeve surrounding a setting tube connected to a delivery pipe, the connector comprising also a disconnecting mechanism. The plugging fluid is delivered through the delivery pipe and the setting tube to the sleeve, producing inflation of the sleeve. Nevertheless, the design of the apparatus presents several drawbacks. One of these is that the sleeve design did not incorporate any device or solution to anchor it into the borehole after disconnection. Consequently there is a risk that the weight of a cement column pumped above the tool could push the filled sleeve downward.

It is an object of the present invention to provide an apparatus which obviates or mitigates this drawback.

SUMMARY OF THE INVENTION

The invention provides an apparatus to be lowered in a borehole, comprising: (i) a delivery section for delivering a plugging fluid; (ii) a setting section comprising a longitudinal element and a flexible and permeable sleeve into which the plugging fluid is delivered; and (iii) a disconnect mechanism to allow the delivery section to be disconnected from the setting section, characterized in that the flexible sleeve is connected by at least one floating means to the longitudinal element.

The sleeve is permeable to allow the prior use of the apparatus in other drilling or well operations. Effectively, the permeable sleeve allows flow of mud or non fibrous fluid through the sleeve, but stops flow for compact fluid as cement or fibrous fluid. Preferably, the disconnect mechanism disconnects the delivery section from the setting section when the flexible sleeve is inflated inside the borehole at a given pressure. The given pressure is defined below the burst pressure of the flexible sleeve. Then, the setting section is left in the borehole and acts as a plug.

Preferably, the flexible sleeve is connected by two floating means to the longitudinal element, the longitudinal element being a tube. The floating means allow a free displacement by translation on the longitudinal element. The floating means can comprise a brake. The longitudinal element can further comprise shoulder(s) (90A and/or 90B) which will act as a limit stop against the floating means. This system of floating means ensures a perfect anchoring of the setting section inside the borehole and positioning on the borehole.

Preferably, the disconnect mechanism comprises a pin end or box end located on the setting section, an opposite, respectively box end or pin end on the delivery section and a sliding sleeve retaining the pin end and box end in connected position. Further, the disconnect mechanism functions only thanks to differential pressure existing between the inside of the flexible sleeve and the borehole.

Preferably, the apparatus further comprises a closing mechanism of the setting section which is in close position when the disconnect mechanism is in disconnected position. The closing mechanism can be a valve which operates and closes simultaneously when the delivery section disconnects. Further, the closing mechanism functions only thanks to differential pressure existing between the inside of the flexible sleeve and the borehole.

In another aspect, the invention provides a method of installing a plug in a borehole, comprising: positioning an apparatus as described above in the borehole at a position at which the plug is to be installed, pumping fluid into the flexible sleeve via the delivery section so as to inflate the flexible sleeve, disconnecting the setting section from the delivery section, and withdrawing the delivery section from the borehole leaving the setting section at the position, said setting section acting as the plug.

Preferably, the method further comprises the step of pumping an excess of the fluid into the borehole above the plug. The tightness of the plug is enhanced.

Preferably, the fluid is a cement slurry comprising solid and liquid components to cause a solids enriched layer to build up inside the flexible sleeve.

Preferably, the fluid is a cement slurry further comprising fibers of different types with at least one type being adapted for sealing the flexible sleeve.

BRIEF DESCRIPTION OF THE DRAWINGS

Further embodiments of the present invention can be understood with the appended drawings.

DETAILED DESCRIPTION

The present invention involves the use of a flexible sleeve. The sleeve is also further permeable made from a woven material to permit placement of a cement plug in a borehole under naturally unstable conditions while forcing the cement slurry to remain in the borehole at the desired position. The unstable conditions in which the apparatus and method of the invention can be used include highly deviated and horizontal wellbores, and lost circulation conditions such as can occur in massively fractured formations, or off-bottom positioning of the plug with a layer of borehole or drilling fluid being present in the borehole below the plug.

Figure 1:
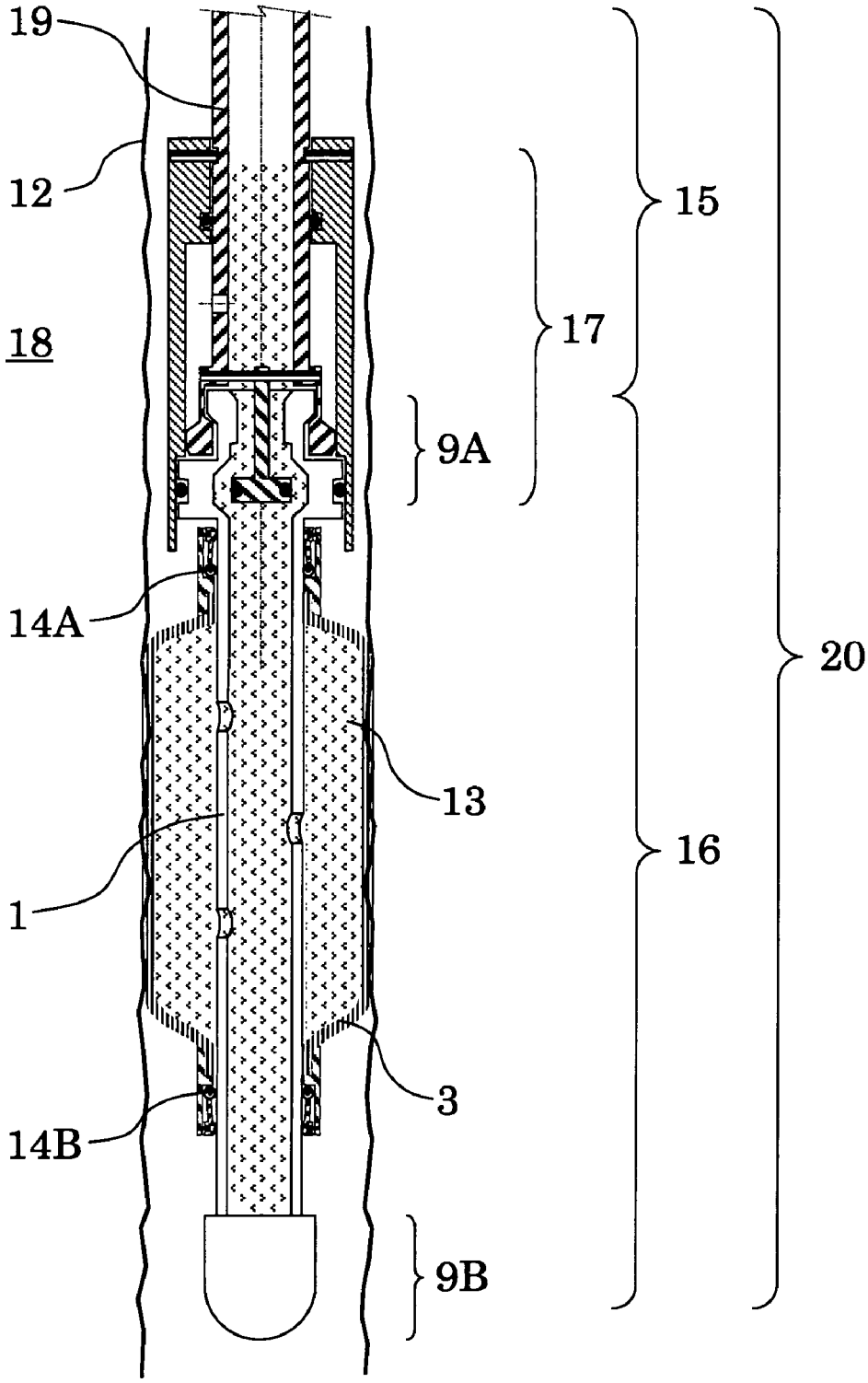
FIG. 1 shows the apparatus according to the invention.

An apparatus 20 for setting plug according to the invention is shown in FIG. 1. The apparatus 20 is principally made of two parts which are a delivery section 15, mainly composed of a delivery pipe 19 and a setting section 16, mainly made of a stinger 1 which is surrounded by a sleeve 3. The delivery pipe 19 can be a drill pipe or a coiled tubing or casing. The apparatus 20 is lowered in a wellbore or borehole 12 surrounded by a formation 18. The apparatus 20 further comprises a disconnect mechanism 17 to allow the delivery section to be disconnected from the setting section.

Figure 2A:
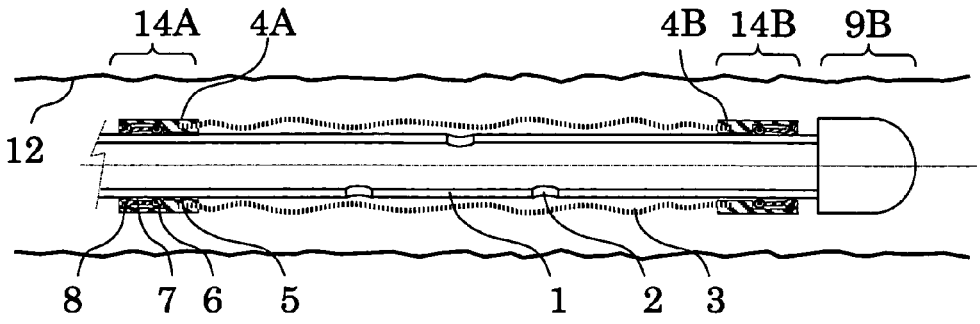
FIG. 2A shows details of the apparatus according to one embodiment of the invention with expandable sleeve deflated.
Figure 2B:
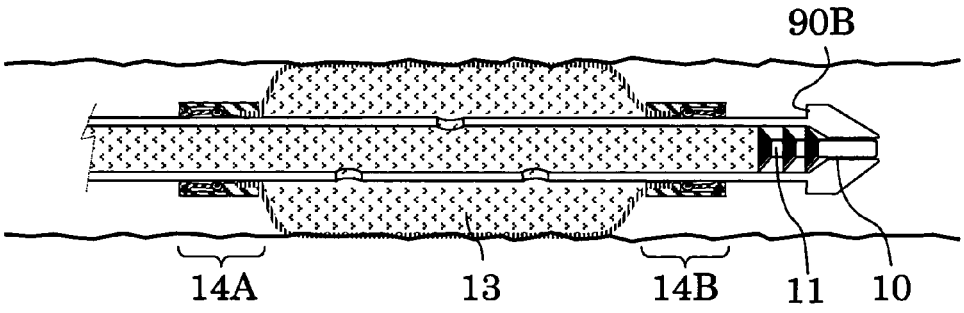
FIG. 2B shows details of the apparatus according to second embodiment of the invention with expandable sleeve inflated.

Some parts of the apparatus 20 are further shown in details in the FIGS. 2A, 2B, 2C and 2D. FIGS. 2A and 2B are views in detail of a part of the setting section 16. The setting section or setting tool comprises a tube or stinger 1 with one or several openings 2, a sleeve or bladder 3 attached at both extremities on attachment means 4A, 4B that fit the outside diameter of the stinger. The stinger 1 is made of a rigid but drillable stinger with a material such as light metal or alloy, e.g. aluminum or such as friable plastic or composite e.g. fiberglass, epoxy resin materials. The material, when drilled, has to transform rapidly and easily in small cuts. The openings 2 allow a plugging fluid 13 to flow into the bladder 3; they are located in the center of the stinger. The bladder 3 is made of a flexible and permeable sleeve. When the plugging fluid is flowing into the bladder, the bladder inflates (FIG. 2B). The sleeve can be formed from a woven carbon fiber or Kevlar material (it will be appreciated that other materials can also be used).

Figure 2C:
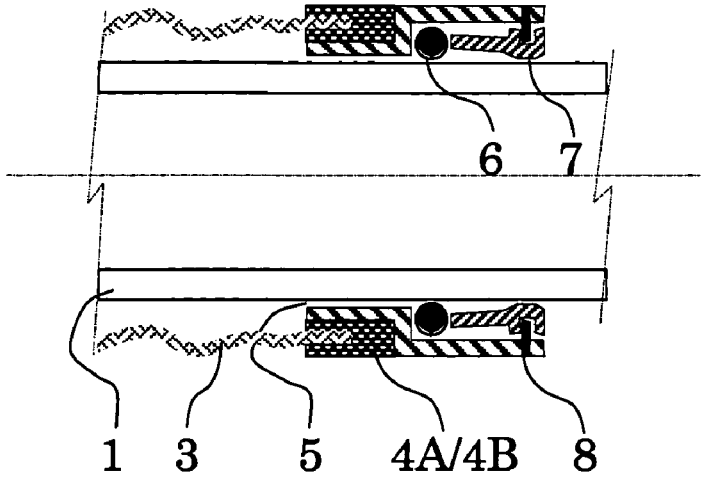
FIG. 2C shows details of the apparatus according to the invention with floating means.

FIG. 2C is a view in details of one attachment means. According to the invention, the bladder 3 is connected to the stinger 1 with at least one attachment means 4A or 4B which is a floating means 14A or 14B, meaning that it can allow a free displacement of the attachment means 4A or 4B on the stinger. For this reason, the floating means 14A or 14B fit the outside diameter of the stinger. Preferably, and as shown on FIGS. 2A and 2B the both attachment means 4A and 4B are floating means 14A and 14B. The floating means 14A and 14B are made from a drillable material such as aluminum, fiberglass, epoxy resin materials, etc. The plugging fluid cannot leak between the floating means and the stinger, thanks to a close adjustment 5 and/or a sealing element 6. The close adjustment is obtained by tight tolerance on diameters and is sufficient as the plugging fluid can fill in the gap. Further, the sealing element can be used such as a metallic seal or other type of seal.

Preferably, each floating means is equipped with a brake 7 to control the friction over the stinger 1. For example, the brake can be an elastic collet or spring collet, pressed against the stinger by means of spring or screws 8. The brake friction is set so that the weight of the plugging fluid 13 filling the inflated bladder 3 cannot move the entire system {plugging fluid inside the bladder, bladder, floating means}. The spring or screws 8 can be pre-adjusted before operation or adjusted during operation with an added automatic system of regulation (not shown).

FIG. 2A shows the setting tool according to one embodiment of the invention where the lower extremity 9B of the stinger 1 is closed and does not allow communication between the inside of the stinger and the borehole. The lower extremity is the extremity which is first lowered in the wellbore, and which is at bottom hole when the wellbore is vertical. This way, the permeable bladder 3 and the opening 2 allow filling the delivery pipe with the mud contained in the well, and mud circulation to condition the well.

FIG. 2B shows the setting tool according to a second embodiment of the invention where the lower extremity 9B of the stinger 1 comprises an opening 10 and does allow communication between the inside of the stinger and the borehole. Effectively this way with a large flow path with the opening 10, the stinger remains open while running into the well, in order to fill the delivery pipe with the mud contained in the well, and to allow mud circulation to condition the well. However, the opening 10 must be closed for the bladder 3 to inflate and a lower closing mechanism has to be used. For example, the opening 10 can be a seat for a lower closing mechanism as a dart 11 or a ball. In one embodiment, the dart 11 is pumped down whenever needed to close the lower extremity 9B, lands into the seat and plugs the flow path (FIG. 2B). In another embodiment, a sleeve-type valve (not shown) is installed, for an automatic closure when the setting tool is pulled upward inside the wellbore 12, or when the setting tool is extracted from its protector, as described in European patent application 04292174.2, from the same applicants. The lower extremity 9B of the stinger 1 further contains a shoulder 90B which ensures a stop for the floating means 14B.

Figure 2D:
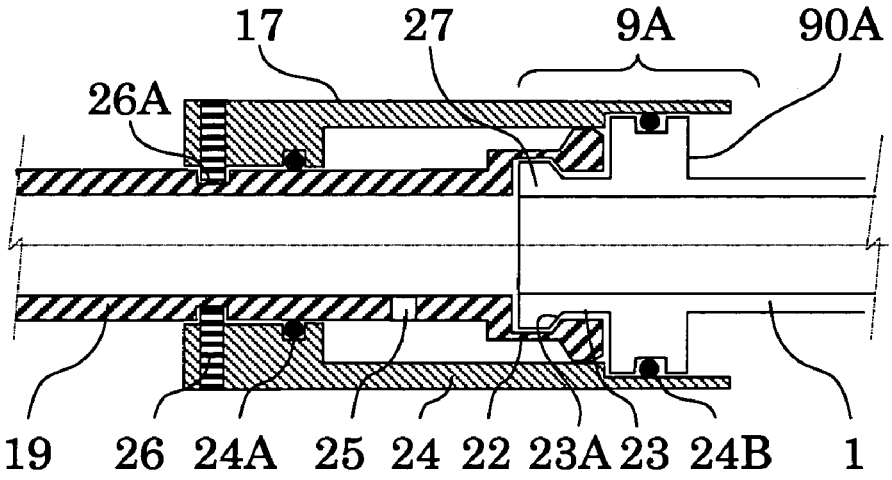
FIG. 2D shows details of the apparatus according to the invention with disconnecting mechanism.

FIG. 2D is a view in details of the upper extremity of the setting tool showing the disconnect mechanism 17. The setting tool comprises at the upper extremity 9A of the stinger a connector 27 allowing a disconnection of the setting tool or setting section 16 from the delivery section 15. The upper extremity is the opposite extremity to the lower extremity. The connector 27, which will act as the pin end, is connected to the delivery pipe 19 by elastic fingers 22 or keys, which will act as the box end. The elastic fingers engage into a groove 23 cut into the stinger 1. A ramp 23A allows disengagement of the elastic fingers 22 from the groove 23. The elastic fingers are made of an elastic metal or elastic plastic or composite material. A sliding sleeve 24 surrounding the delivery pipe 19 is further present and can displace along the delivery pipe to cover the system {pin end, box end}. The sliding sleeve 24 is made of metal or plastic or composite material. Preferably, the sleeve is equipped with a brake pressing against the delivery pipe or a locking mechanism 26 to maintain the sleeve in position. For example, the locking mechanism 26 can be made of one or several shear screws engaged in a groove 26A cut in the delivery pipe 19. A first seal 24A is located on the sliding sleeve 24 and ensures tightness between sliding sleeve 24 and delivery pipe 19. A second seal 24B is located on the stinger 1 and ensures tightness between sliding sleeve 24 and stinger 1. The diameters of the seals 24A and 24B are different; the diameter of the seal 24B is larger than the diameter of the seal 24A.

The upper extremity 9A of the stinger 1 further contains a shoulder 90A which ensures a stop for the floating means 14A. The delivery pipe further comprises an orifice 25 which ensures communication of the plugging fluid 13 from the delivery pipe to the internal cavity created by the sliding sleeve 24. The system {pin end, box end, sliding sleeve} corresponds to the connection/disconnection mechanism 17. The upper extremity of the setting tool further comprises an upper closing mechanism so that the bladder can be inflated but the plugging fluid can not flow back. The upper closing mechanism will be described in more details here below.

The floating means 14A and 14B brings two main advantages. First, the bladder will never be submitted to a tensile load higher than the brake friction. Useless stresses being eliminated, the optimum pressure rating is guaranteed. Secondly, as said before, the drawback of prior art system is that the bladder design did not incorporate any device or solution to anchor it into the borehole after disconnection. The applicants demonstrate that a setting tool comprising floating means can act as anchoring means. The setting tool with floating means plays cleverly on pressure applied on the bladder and thanks to those pressure differences remains in place.

Figure 3:
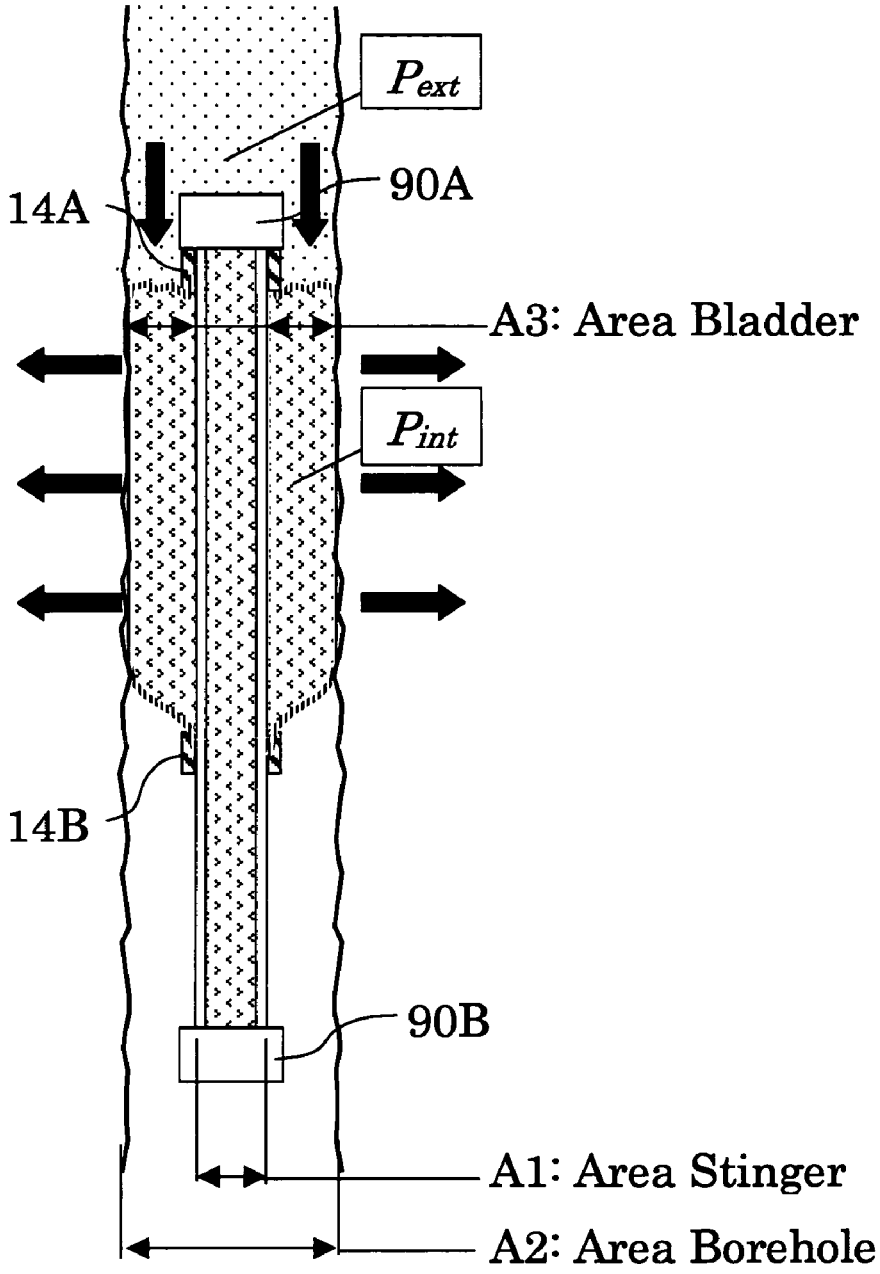
FIG. 3 shows the functioning principle of the floating means acting as anchoring means.

FIG. 3 is a schematic view showing the functioning principle of the floating means acting as anchoring means. Once the plugging element has been set in the borehole, the stinger is closed at both extremities 9A, 9B and is free to translate. Whenever a differential pressure is applied across the plugging element, the stinger will move full way until the shoulder 90A or 90B at one extremity stops and pushes against one floating means 14A or 14B. The skill in the art will appreciate that this way only one floating means is sufficient to create an anchoring means. Generally, the differential pressure comes from upper and it is the shoulder 90A which pushes against floating means 14A (as shown on FIG. 3). As a result, the system is acting as a pressure amplifier: the external pressure $P_{ext}$ acting on the whole borehole area increases the pressure $P_{int}$ inside the bladder, until the following balance is reached:

$$P_{ext} \cdot A2 = P_{int} \cdot A3 \quad \text{(Equation 1)}$$

$$A2 = A3 + A1 \quad \text{(Equation 2)}$$

wherein, $P_{ext}$ is the external pressure in the borehole, $P_{int}$ is the internal pressure inside the bladder, A1 is the area of the stinger in cross-section, A2 is the area of the borehole in cross-section and A3 is the area of the bladder inflated in cross-section.

$$\frac{P_{int}}{P_{ext}} = \frac{A1 + A3}{A3} > 1 \quad \text{(Equation 3)}$$

According to the size of the stinger, the ratio between internal and external pressure can reach up to 1.2, i.e. the internal pressure always stays up to 20% above the external pressure. The internal pressure of the bladder is interesting, as it creates some friction against the borehole, which tends to lock the plugging element in place. As a result, the friction is proportional to the differential pressure applied on the bladder, and the plugging element stays in place with this "hydraulic lock", whatever load is applied, as long as the internal bladder pressure stays below the burst bladder pressure. For example, a test has been realized with a plugging element set in a slick metal tube. The test was simulating a borehole with a very low friction, the worst case imagined, and enough pressure was applied on one extremity to generate a 42 tons load that tends to move the plugging element of the slick metal tube. Even in that extreme condition, the plugging element perfectly stayed in its initial position.

The disconnecting mechanism 17 allowing a disconnection of the setting tool or setting section 16 from the delivery section 15 presents also an advantage. In prior art systems, the connector is actuated by a physical means (dart or ball) pumped down after the volume of plugging fluid required for the sleeve inflation. This method requires a preliminary calculation of the open-hole volume, which cannot be accurate as the formation can be washed out during drilling. Consequently a safety margin for the volume of plugging fluid must be applied, and there must be one or several safety ports, initially plugged by a shear membrane or a pressure operated valve, which adds complexity to the design. The plugging fluid in excess will be vented through the ports to avoid bursting of the sleeve.

Figure 4A:
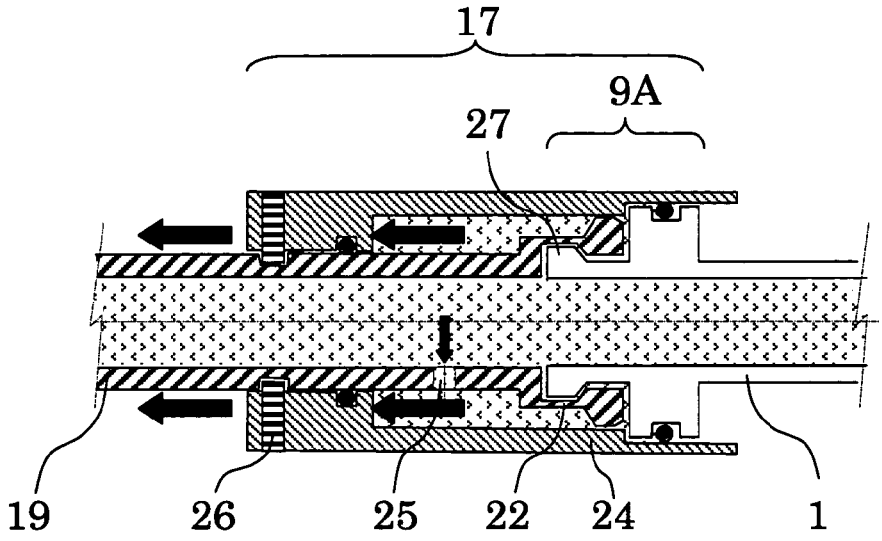
FIG. 4A shows the functioning principle of the disconnecting mechanism (connected position).
Figure 4B:
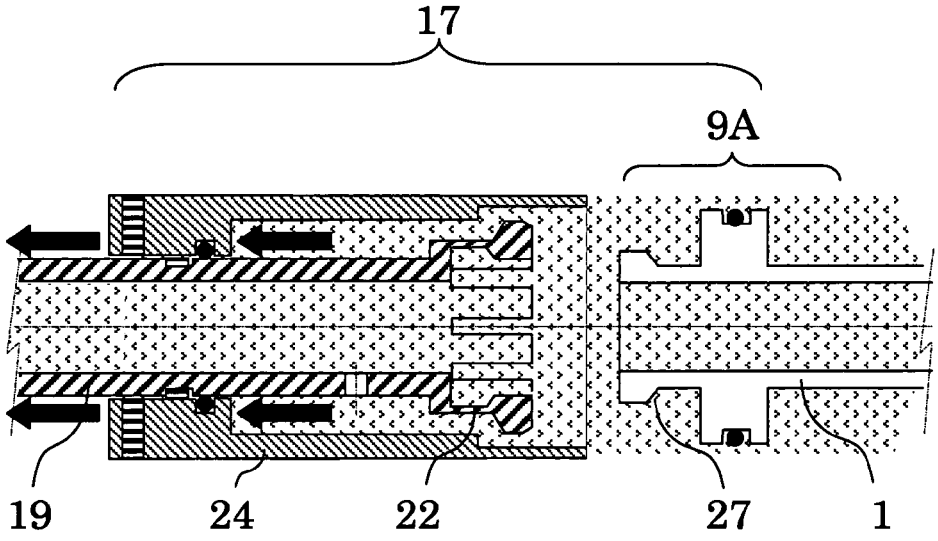
FIG. 4B shows the functioning principle of the disconnecting mechanism (disconnected position).

In the present invention, the connector 27 acts as a "hydraulic connector" located between the stinger 1 and the delivery pipe 19. FIGS. 4A and 4B show the connector 27 in action of disconnection. FIG. 4A shows the connector locked to the delivery pipe 19. The elastic fingers 22 engaged into the groove 23 and can not retract as long as the sliding sleeve 24 is covering them. An internal cavity is formed between the sliding sleeve and the delivery pipe and tightness is maintained in the cavity thanks to both seals 24A and 24B. Through the orifice 25 the same differential pressure is applied inside the cavity than inside the bladder. Thus the sliding sleeve 24 is sensible to the same differential pressure as the bladder, but it is secured in its initial locked position by the locking mechanism 26. The diameters of the seals 24A and 24B are different so the internal pressure of the plugging fluid 13 acting on the differential area (created by difference of diameters of the seals 24A and 24B) induces a load that tends to move the sliding sleeve 24 against the brake or locking mechanism 26. If the differential pressure increases above a given threshold, the induced axial load shears the locking mechanism and the sliding sleeve translates to the unlocked position (shown on FIG. 4B). As shown on FIG. 3, the diameter of the seal 24B is larger than the diameter of the seal 24A, the sliding sleeve 24 translating on the delivery pipe 19 and remaining on it. Another symmetric configuration could be obtained where the diameter of the seal 24A is than the diameter of the seal 24B, the sliding sleeve 24 translating on the stinger 1 and remaining on it. The locking mechanism sets the threshold below the burst pressure of the bladder. When the sliding sleeve moves, it frees the elastic fingers 22, and the ramp 23A pushes the elastic fingers 22 away, disconnecting the delivery pipe. In fact, the sleeve acts as a piston.

The upper closing mechanism from prior art presents some drawbacks. Effectively, in prior art systems, after disconnection, a non-return valve closes the sleeve to prevent plugging fluid flowing back and deflating the sleeve. The upper extremity of the stinger can be equipped with a non-return valve, so that the bladder can be inflated but the plugging fluid cannot flow back. However, the non-return valve induces several drawbacks. First, no reverse circulation is possible during running in hole, when the lower extremity of the stinger is still open. Reverse circulation offers the advantage of a higher return velocity, which is good to remove cuttings and solids out of the hole. Secondly, the actuation of such a valve is weak, as a spring is involved and the geometry does not allow a large size. Thus solids or fibers contained into the plugging fluid could potentially prevent a correct closure of the valve. In that case the sleeve would deflate and fall down into the borehole. Lastly, the flow path being very small because the spring tends to maintain the valve closed, there is a risk that solids or fibers contained into the plugging fluid can plug the valve and prevent any further inflation of the bladder.

Figure 5A:
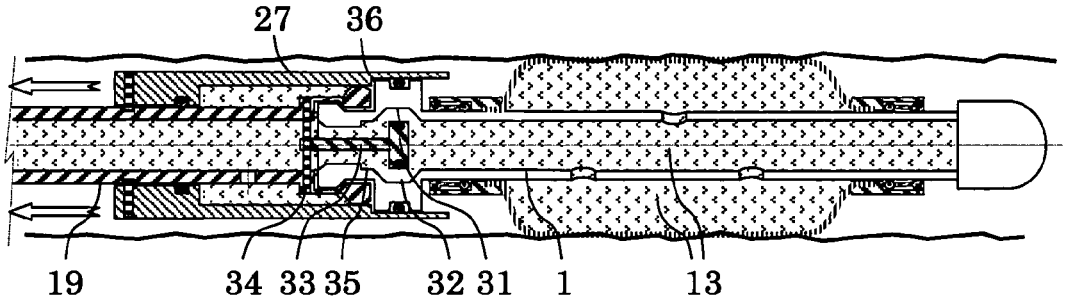
FIG. 5A shows the functioning principle of the automatic valve (open position).
Figure 5B:
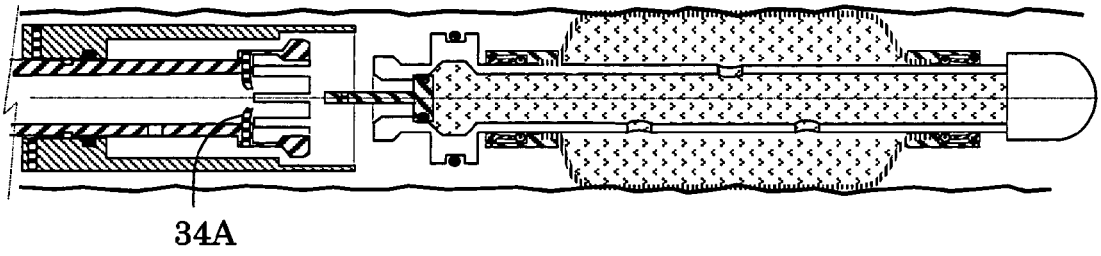
FIG. 5B shows the functioning principle of the automatic valve (close position).

Therefore in the present invention, another upper closing mechanism has been designed, with some major advantages. An automatic valve, taking advantage of the hydraulic connector, is used. FIGS. 5A and 5B show the automatic valve in action. FIG. 5A shows the automatic valve when the hydraulic connector is locked. A solid disc 31 comprising a seal 36 is initially located in the center of an internal groove 32 cut into the stinger 1, in order to allow a large flow path around the disc for the plugging fluid. The disc is maintained in place by a tail 33 secured to the delivery pipe 19 by a shearable means such as shear pin 34. So, the valve stays open as long as the connector 27 is engaged. When the connector 27 disconnects, the movement of the delivery pipe 19 pulls the solid disc 31 upward. The disc engages in a bore 35 where it seals thanks to seal 36. In another embodiment (not shown on Figures) an elastic ring attached to the disc can expand into a groove cut into the bore to lock the disc in place, so the valve is permanently closed. Pulling further will shear the pin 34 (shown on FIG. 5B as 34A), so that the delivery pipe and upper connector can be retrieved, leaving the closed bladder assembly in place. FIG. 5B shows the automatic valve when the hydraulic connector is unlocked.

All the parts of the apparatus 20 can be machined with very common piece of equipment in the industry; enhancing the easy manufacturability.

The delivery section 15 is generally a drill pipe or coiled tubing or other types of tubes that can supply plugging fluid; it can also be a casing for special primary cementing, for example in total loss cases. Furthermore, the delivery section 15 can be another type of delivery system than a tube, for example an apparatus as described in patent application WO 04/072437 can be used downhole to move the setting section where desired and further supplying energy and plugging fluid. The setting section 16 is generally a stinger or longitudinal tube; it can also be a perforated casing or slotted liner.

Figure 6:
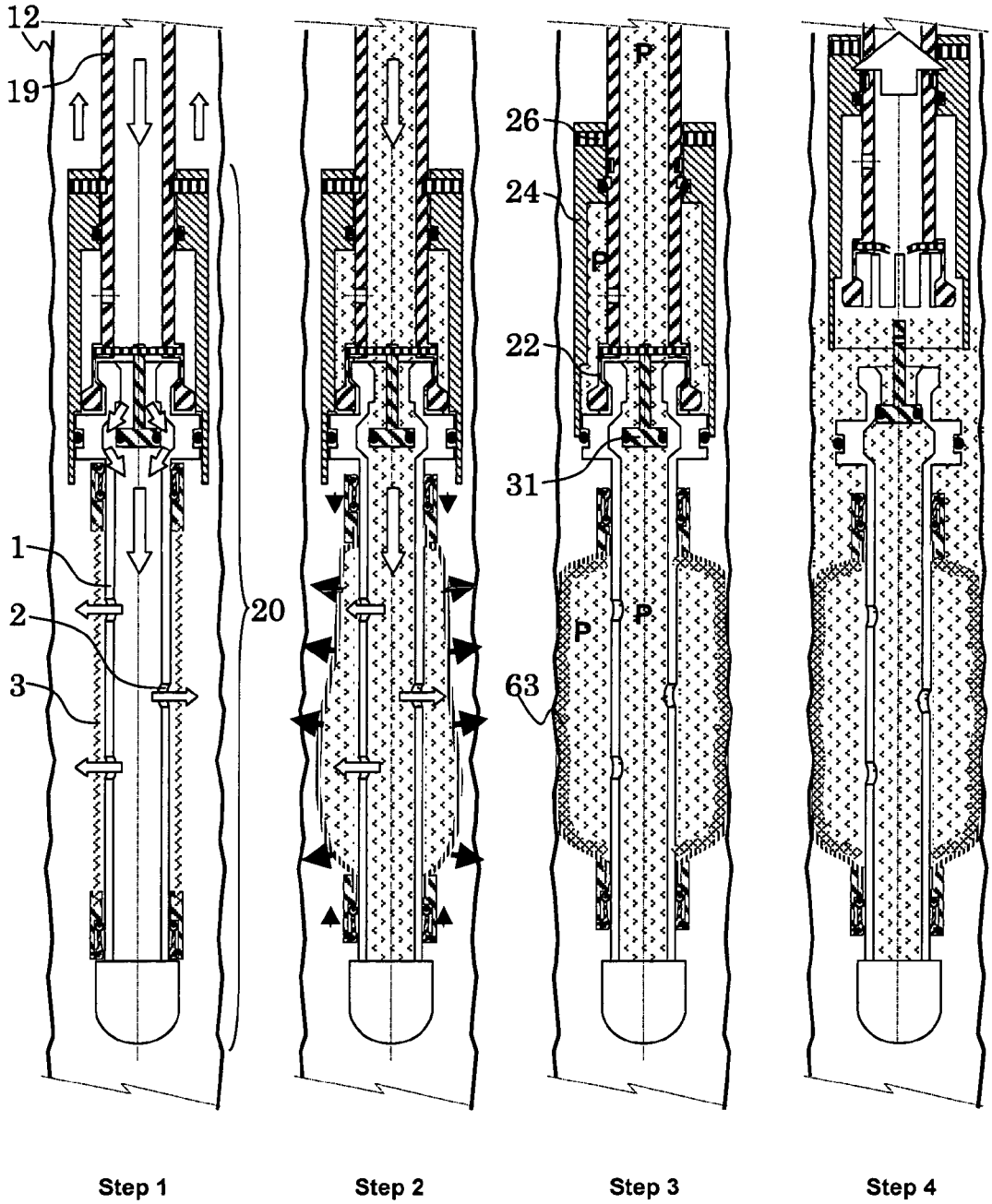
FIG. 6 is a schematic view illustrating some key steps of the operating sequence according to the invention.

FIG. 6 shows a schematic view illustrating some key steps of the operating sequence of the invention with the apparatus described above. Preferably, the apparatus according to the invention is used with the protector disclosed in European patent application 04292174.2, from the same applicants. In FIG. 6, step 1, the apparatus is lowered in a borehole 12, the bladder 3 being deflated and allowing a free circulation of mud from the delivery pipe 19 to the annulus formed between borehole wall and apparatus 20, through the opening 2 and the permeable bladder 3. In FIG. 6, step 2, a cement slurry is pumped through the delivery pipe 19 from mixing equipment at the surface (not shown) and through the stinger 1 so as to inflate the bladder 3 until it comes in contact with the borehole walls. Pumping is continued so that a cement cake 63 is formed inside the bladder 3 (shown on FIG. 6, step 3), and the pressure inside the bladder 3 increases. The cement cake 63 will provide higher mechanical strength due to its increased solids content. As a pre-defined pressure P is reached (corresponding to the shear pressure of the locking mechanism 26), the sliding sleeve 24 liberates the elastic fingers 22, which itself liberate the stinger 1. The automatic valve 31 closes the setting section avoiding cement slurry to flow out of the bladder. As shown in FIG. 6, step 4, the slurry in excess can be pumped in the borehole above the bladder. Then, the delivery pipe 19 (drill string or coil tubing or casing) is then pulled out using the well known balanced plug rules to prevent mixing the cement with the displacement fluid and the cement slurry is allowed to set.

The apparatus and method described above has the advantages of: prevention of fluid swapping—the cement slurry is not mixed with the fluid left underneath the tool; reduced loss of fluid to the formation; and strong mechanical properties of the cement, allowing for instance side-tracking (this is made possible by either the squeeze step, or the use of metallic fibers or both together).

The cement slurry used in this process typically includes fibers or mixtures of fibers. These fibers act in various ways, first by helping building a cake on the internal surface of the bladder, then by preventing loss of cement from the borehole above the bladder and finally by increasing the mechanical properties of the set cement to a point such that it will withstand subsequent drilling operations. When only a single type of fiber is used, flexible fibers are preferred: the use of such fibers has previously been proposed for use in lost circulation situations and they prevent the cement sheath from disintegrating after being drilled. When a mixture of fibers is used, a first type of fiber can provide the cement slurry with strong mechanical properties, which are beneficial for instance for kick-off cement plugs. These fibers are for instance the metallic fibers described in WO 99/58467. The second type of fiber can be similar to the flexible fibers described above. The fibers do not need to be added homogeneously to the whole slurry. For example, the flexible fibers can be used for the part of the slurry that inflates the bladder, while metallic fibers can be used in the second part (filling the borehole above the bladder), which needs strong mechanical properties.

When the delivery pipe is a drill pipe and once the cement has set, the drill pipe is reintroduced with a drill bit attached and drilling resumes, drilling through the stinger and cement inside the bladder to leave a remaining part of the bladder and a sheath of cement around the borehole in the zone. It acts as an impermeable barrier between the borehole and the formation that can sustain the hydrostatic pressure of the drilling fluid and so avoid the fluid loss problem. The presence of the cement cap on top of the sleeve and stinger assists in effective resumption of drilling and removal of the stinger. It can be further advantageous to put a whipstock above the apparatus 20 to guide the drill pipe and initiate deviation (kick-off).

In order for the cement slurry to build a cake inside the bladder, it is preferable that the slurry contains a large volume fraction of solids and does not possess too large fluid loss control properties. A composition that provides such properties can utilize an optimized particle size distribution for the solid components of the slurry such as is described in EP 0 621 247. Where a low density cement slurry is required, the approach proposed in WO 01/09056 is preferred. An example of such a base low density slurry is given in Table 1 below:

TABLE 1

| | |
|---|---|
| Class G Cement (20-25 micron) | 35% BVOB |
| Crystalline Silica (1-10 micron) | 10% BVOB |
| Aluminium Silicate Microspheres SG 0.65-0.85 (100-400 micron) | 55% BVOB |
| Polypropylene Glycol antifoam agent | 1 mL/kg (0.025 gal/sk) |
| Water | 0.19 L/kg (5.029 gal/sk) |
| Density | 1.47 g/cm$^3$ (12.13 ppg) |
| Porosity | 43% |

BVOB = by volume of total solids in slurry
gal/sk = gallons per sack of cement
ppg = pounds per gallon
porosity % = (volume of water/volume of slurry) * 100

A suitable base higher density slurry is given in Table 2 below (same abbreviations as Table 1):

TABLE 2

| | |
|---|---|
| Class G Cement (20-25 micron) | 40% BVOB |
| Crystalline Silica (1-10 micron) | 10% BVOB |
| Iron Oxide weighting agent, SG 4.8-6.0 (100-600 micron) | 10% BVOB |
| Silicon Dioxide weighting agent, SG 2.5-2.8 (100-600 micron) | 40% BVOB |
| Polymeric Aliphatic Amide fluid loss control additive | 0.3% BVOB |
| Polypropylene Glycol antifoam agent | 1 mL/kg (0.025 gal/sk) |
| Water | 0.1 L/kg (2.625 gal/sk) |
| Density | 2.24 g/cm$^3$ (18.7 ppg) |
| Porosity | 40.5% |

Fibre material is mixed with the base slurry to provide structure to the mass. Such fibres can be metallic (see, for example, WO 99/58467) or polymeric (see, for example, PCT/EP02/07899). Two suitable fibre materials and a proposed level of use in the cement slurries are given in Table 3 below:

TABLE 3

| Fibre Material | Concentration |
|---|---|
| Novoloid polymer fibres (18-22 mm) | 3 g/L of slurry |
| Amorphous cast metal fibres (5-10 mm) | 100 g/L of slurry |

The strength of the sleeve or bladder 3 material and the cement are important parameters in designing an operation in accordance with the invention. One of the most severe conditions lies in the case of the absence of support from the formation, for example when plugging caverns or highly unconsolidated formations. The strength requirement can be calculated using the following equations:

$$\sigma_t = K\Delta P_a \quad \text{(Equation 4)}$$

With $\Delta P_a$ designating the differential pressure in the borehole, $\sigma_t$ the tangential stress in a solid annulus at the wall of the borehole and K a stress intensity factor which, in the case of a solid unsupported annulus, is equal to $$K = -\left(\frac{r_b^2 + r_a^2}{r_b^2 - r_a^2}\right) \quad \text{(Equation 5)}$$

In which $r_b$ and $r_a$ represent respectively the outside diameter and the inside diameter of the solid annulus.

Using these equations, it is possible to estimate the strength requirements for the mesh and the cement.

If it is assumed that it is wished to consolidate a 10 foot section (304.8 cm) composed of broad cavities, the following procedure can be followed. The bottom of the area is situated at 3000 feet (914 m) with a pressure gradient of 0.3 psi/foot (total losses) (6.8×103 N/m3), that is to say the pressure at the bottom of the section is 3000×0.3=900 psi (6.2×106 N/m2). A cement slurry has, for example, a density of 0.8 psi/foot (1.8×104 N/m3). In order to ensure good coverage of the zone, a height of cement of 100 feet (30.48 m) might be appropriate. At 2900 feet (884 m), the hydrostatic pressure at the top of the column of cement is approximately 900−(100×0.44)=850 psi (5.9×106 N/m2). For simplicity of calculation, the borehole fluid is taken to be water and with a water level at approximately 950 feet (291.39 m), and a total loss situation is assumed. At the bottom of the section, the slurry will impose a pressure on the mesh of 850 psi+(0.8×100) psi=936 psi (6.4×106 N/m2). The differential pressure through the mesh is therefore 36 psi (0.25×106 N/m2). The cement, in the hardened state, must support in that part of the borehole a pressure of 1320 psi (9.1×106 N/m2) if the borehole fluid is water (0.44 psi/foot (9.9×103 N/m3) with a column height of 3000 feet (914 m)). The differential pressure for the cement is therefore 1320−900=420 psi (2.9×106 N/m2). If the borehole fluid is heavier than water, the differential pressure increases accordingly.

The strength of the mesh forming the sleeve is an important parameter. For example, assuming an 8×8 hard drawn, high carbon content steel cable mesh with a nominal yield strength of 300,000 psi (2068.4×106 N/m2), having a mesh diameter of 0.71 mm, an opening of 2.47 mm (a 5 mm steel fiber is not capable of passing through such an opening), the average tangential force over the volume occupied by the mesh is approximately 250 times the differential pressure, that is to say approximately 9000 psi (62×106 N/m2) (using equation 2 above) and an outside diameter of the mesh of 355.6 mm. The tensile stress on the cables is approximately 9000×(2.47+0.71)70.71=40,000 psi (275.8×106 N/m2).

In this calculation the average stress applied to the volume of the mesh is redistributed over the volume of the fibers. This simplified approach suggests that the mesh selected is capable of supporting and withstanding approximately 7 times the differential pressure of 36 psi (0.25×106 N/m2) before beginning to yield. The actual tensile strength of the mesh itself will depend in fact on many other parameters such as the orientation of the steel cables, the material used, etc. For example, a carbon fiber mesh has a tensile strength of approximately 640,000 psi (4414×106 N/m2). It appears at the present time that the mesh can provide appreciable support for the cement. It is also possible to envisage the use of a cement of lower density.

Similar calculations are made for cement. Assuming that the cement is not supported by the formation because of the presence of cavities, and the support afforded by the mesh is ignored, it is possible to apply the following reasoning: for a mass of cement having an outside diameter (equal to the diameter of the mesh) twice that of its inside diameter, the tangential tensile stress in the cement at the wall of the borehole is ⅔ times the differential pressure, according to equation 2, that is to say 700 psi (4.8×106 N/m2). This means that it is necessary to use a reinforced cement with a tensile strength of at least 700 psi (4.8×106 N/m2), typically comprising metallic fibers. Well cements with a tensile strength of 1000 psi (6.89×106 N/m2) are known.

In order to increase the reliability of the system, the mesh must be sufficiently strong to support the cement. The use of a cement with lower density or application to a shorter length of the stabilization zone will reduce the strength requirement of the mesh during the placing of the cement. The outside diameter can also be increased in order to reduce the tensile stress on the cement sheath.

The sleeve is preferably highly flexible in order to adapt to the dimensions and shape of the borehole whilst retaining good mechanical strength. Therefore carbon fibre, Kevlar or steel bands can be used. An appropriate material has a high tensile strength under downhole conditions and is not excessively degraded by fluids present in the well, at least until a permanent casing is installed. The structure of the mesh affords the required flexibility. However, it may also be necessary to be able to drill through the sleeve, the cement providing an impermeable layer, which makes it possible to drill the borehole without loss of circulation and increases the strength of the structure.

The invention claimed is:

1. An apparatus to be lowered in a borehole, comprising:

i) a delivery section for delivering a plugging fluid;

ii) a setting section comprising a longitudinal element and a flexible and permeable sleeve into which the plugging fluid is delivered, wherein the flexible sleeve is connected by at least one floating means to the longitudinal element; and iii) a disconnect mechanism to allow the delivery section to be disconnected from the setting section;

wherein the disconnect mechanism comprises a pin end or box end located on the setting section, and respectively a box end or pin end on the delivery section and a sliding sleeve retaining the pin end and box end in connected position.

2. The apparatus of claim 1, wherein the disconnect mechanism disconnects the delivery section from the setting section when the flexible sleeve is inflated inside the borehole at a given pressure.

3. The apparatus of claim 2, wherein the flexible sleeve is connected by two floating means to the longitudinal element, said longitudinal element being a tube.

4. The apparatus of claim 1, wherein the flexible sleeve is connected by two floating means to the longitudinal element, said longitudinal element being a tube.

5. The apparatus of claim 4, wherein one or both floating means comprise a brake.

6. The apparatus of claim 1, wherein at least one floating means comprise a brake.

7. The apparatus of claim 6, wherein the disconnect mechanism is only actuated by the differential pressure existing between the inside of the flexible sleeve and the borehole.

8. The apparatus of claim 1, wherein the longitudinal element comprises at least one shoulder and said shoulder acting as a limit stop against the floating means.

9. The apparatus of claim 1, further comprising a closing mechanism of the setting section which is in closed position when the disconnect mechanism is in disconnected position.

10. The apparatus of claim 9, wherein the closing mechanism is only actuated by the differential pressure existing between the inside of the flexible sleeve and the borehole.

11. The apparatus of claim 1, further comprising a closing mechanism of the setting section which is a valve which operates and closes simultaneously when the delivery section disconnects.

12. The apparatus of claim 11, wherein the closing mechanism is only actuated by the differential pressure existing between the inside of the flexible sleeve and the borehole.

13. The apparatus of claim 1, wherein the disconnect mechanism is only actuated by the differential pressure existing between the inside of the flexible sleeve and the borehole.

14. The apparatus of claim 1, wherein the delivery section is a delivery pipe taken in the list: drill pipe, coil tubing, casing.

15. The apparatus of claim 1, wherein the flexible sleeve has a mesh-like structure.

16. The apparatus of claim 12, wherein the flexible sleeve is formed from steel bands, glass fiber, carbon fiber, Kevlar or combination thereof.

17. The apparatus of claim 1, wherein the setting section is made of a drillable material comprising light alloy or plastic or composite.

18. A method of installing a plug in a borehole, comprising:

positioning an apparatus of claim 1 in the borehole at a position at which the plug is to be installed, pumping fluid into the flexible sleeve via the delivery section so as to inflate the sleeve, disconnecting the setting section from the delivery section, and withdrawing the delivery section from the borehole leaving the setting section at the position, said setting section acting as the plug.

19. The method of claim 18, further comprising the step of pumping an excess of the fluid into the borehole above the plug.

20. The method of claim 18, wherein the fluid is a cement slurry comprising solid and liquid components to cause a solids enriched layer to build up inside the flexible sleeve.

21. The method of claim 18 wherein the fluid is a cement slurry further comprising fibers of different types with at least one type being adapted for sealing the flexible sleeve.

22. A method of installing a plug in a borehole, comprising:

positioning an apparatus of claim 4, in the borehole at a position at which the plug is to be installed, pumping fluid into the flexible sleeve via the delivery section so as to inflate the flexible sleeve, disconnecting the setting section from the delivery section, and withdrawing the delivery section from the borehole leaving the setting section at the position, said setting section acting as the plug.

* * * * *